US010925416B2

(12) United States Patent
Melnikov

(10) Patent No.: US 10,925,416 B2
(45) Date of Patent: Feb. 23, 2021

(54) CAPSULE FOR STORAGE AND EXAMINATION OF A COIN

(71) Applicant: LLC "Russian numismatic grading agency", Moscow (RU)

(72) Inventor: Alexander Vladimirovich Melnikov, Moscow (RU)

(73) Assignee: LLC "Russian Numismatic Grading Agency ", Moscow (RU)

( * ) Notice: Subject to any disclaimer, the term of this patent is extended or adjusted under 35 U.S.C. 154(b) by 145 days.

(21) Appl. No.: 16/324,415

(22) PCT Filed: Aug. 10, 2016

(86) PCT No.: PCT/RU2016/000527

§ 371 (c)(1),
(2) Date: Feb. 8, 2019

(87) PCT Pub. No.: WO2018/030907

PCT Pub. Date: Feb. 15, 2018

(65) Prior Publication Data

US 2019/0167018 A1 Jun. 6, 2019

(51) Int. Cl.
*A47G 1/12* (2006.01)

(52) U.S. Cl.
CPC ..... *A47G 1/12* (2013.01)

(58) Field of Classification Search
CPC ..... A47G 1/12; G07D 9/002; G07D 9/004; G07D 9/006; G07D 9/02; A45C 2001/104; A45C 2001/105; A45C 2001/102; A45C 1/10
USPC ..... 206/0.8
See application file for complete search history.

(56) References Cited

U.S. PATENT DOCUMENTS 3,057,459 A * 10/1962 Burdick ..... A47G 1/12 206/0.83
3,229,809 A * 1/1966 Spadaro ..... A47G 1/12 206/0.82
5,042,650 A * 8/1991 Mayer ..... A47G 1/12 206/0.8
6,470,574 B1 * 10/2002 Strumke, Jr. ..... A47G 1/12 15/236.07

* cited by examiner

*Primary Examiner* — King M Chu
(74) *Attorney, Agent, or Firm* — Aleksandr Smushkovich

(57) ABSTRACT

A capsule is proposed for storage of a collector coin of various shapes and sizes, which ensures its preservation and identification. The capsule includes a body joined with a cover, upper and lower inserts having holders shaped as prisms and protruding therefrom, with slots made therein for inserting and fixing the coin. The capsule allows a complete view of the coin, including its rim, and inability to remove it after encapsulation without damaging the capsule. The body preferably combines two opposite cylinder segments coupled with two opposite open four-folded walls. Each wall forms a gap with two end ribs, attached to the segments from above and below respectively. The inserts incorporate minimum three holders in total. The inserts include cavities created between the holders for containing the coin. A method for placing the coin includes inserting it in the slot, and joining the body and cover preferably using ultrasonic welding.

5 Claims, 2 Drawing Sheets

CAPSULE FOR STORAGE AND EXAMINATION OF A COIN

CROSS-REFERENCE TO RELATED APPLICATIONS

This application is a U.S. national stage application of a PCT application PCT/RU2016/000527 filed on 10 Aug. 2016, published as WO/2018/030907, whose disclosure is incorporated herein in its entirety by reference.

FIELD OF INVENTION

The present invention relates to devices for coin collection storage.

BACKGROUND OF THE INVENTION

Devices for coin and medal storage and examination are known in the prior art (see Patent RU No. 2113159, issued Feb. 25, 1997).

The devices for storage and examination of a coin or medal typically comprise a body with a cover, which is connected to the latter using linking parts with a possibility of compulsory disjunction, and a slot for placement of the coin, which is located on the inner surface of the bottom part of the body or cover and formed by protrusions or a single protrusion with formation of a free section of the surface. The free section of the surface is limited by the wall surface of the single protrusion or surfaces of a plurality of protrusions, which match the diameter of the coin or medal. The body and the cover are made of a transparent material. The device provides ease of use with simpler structure.

A module for coin and medal storage and examination is also known in the prior art (see Patent RU No. 2537279, issued Apr. 9, 2010).

The module relates to devices for storage of collectible items and, more particularly, relates to a flat holder, with an aperture where a transparent detachable capsule with a cavity for storage and examination of coins or medals is fixed. The module comprises a detachable flat capsule made of a transparent material in the form of a body and a cover interlinked with each other, fixed in the aperture of the flat holder and fixed in relation to it using protrusions on their outer surfaces along the perimeter of each of them. Each capsule is equipped with a separate holder having square outer shape.

These devices differ from the present invention fundamentally, since the goal of coin encapsulation is not only their preservation, but also their identification and storage without the need of removal from the rigid and convenient capsule (herein also referred to as 'slab'). After the coin is placed inside the capsule, the cover of the slab is sealed and removal of the coin therefrom without damaging the capsule is not possible, unlike in the abovementioned devices.

Rectangular slabs for coin storage intended for both coin preservation and identification are also known in the prior art. These capsules constitute a transparent rectangular plastic container and are made of a material which guarantees coin preservation; the capsules are sealed after coins have been placed inside.

Therewith, known devices and methods of collector coin storage have a number of disadvantages: they do not provide a possibility of examination of coins from all sides (the coin rim is not visible), and have limitations for storage of coins with irregular shapes.

These disadvantages are caused by the shape of the holder having rectangular shape with a recess for coin placement in the middle, which limits overview of the coin.

Unlike those capsules, the proposed "slab" device, while retaining all abovementioned functions, provides a better overview of the encapsulated coin, while reducing requirements to shapes of coins subject to encapsulation.

OBJECT AND BRIEF SUMMARY OF THE INVENTION

The inventive capsule is a rigid and convenient package; it's intended for storage of a collector coin and ensures preservation and identification of the coin. The use of the inventive capsule makes it possible to achieve the following goals:

1. Almost complete isolation of the coin from the environment, preventing its mechanical damage, including severe oxidization.
2. Guarantee of coin authenticity, its identification.
3. Expert opinion regarding the state of the coin (by Sheldon scale).

Apart from that, the task of the invention is to provide a possibility of a 100% overview of a collector coin, including examination of the rim of the coin. A unique shape of the capsule provides the solution for this task.

Coin holders contemplated by the present invention are designed to allow encapsulation of any coins, including those having flaws, rough edges, irregular shape etc., as well as coins of various sizes and diameters.

Additionally, the shape of the inventive capsule provides for a possibility to indicate identification information for the collector coin in an upper part of the capsule's body, allowing easy identification and appraisal of it without any special knowledge.

DESCRIPTION OF THE DRAWINGS OF THE INVENTION

DETAIL DESCRIPTION OF THE INVENTION

Figure 1:
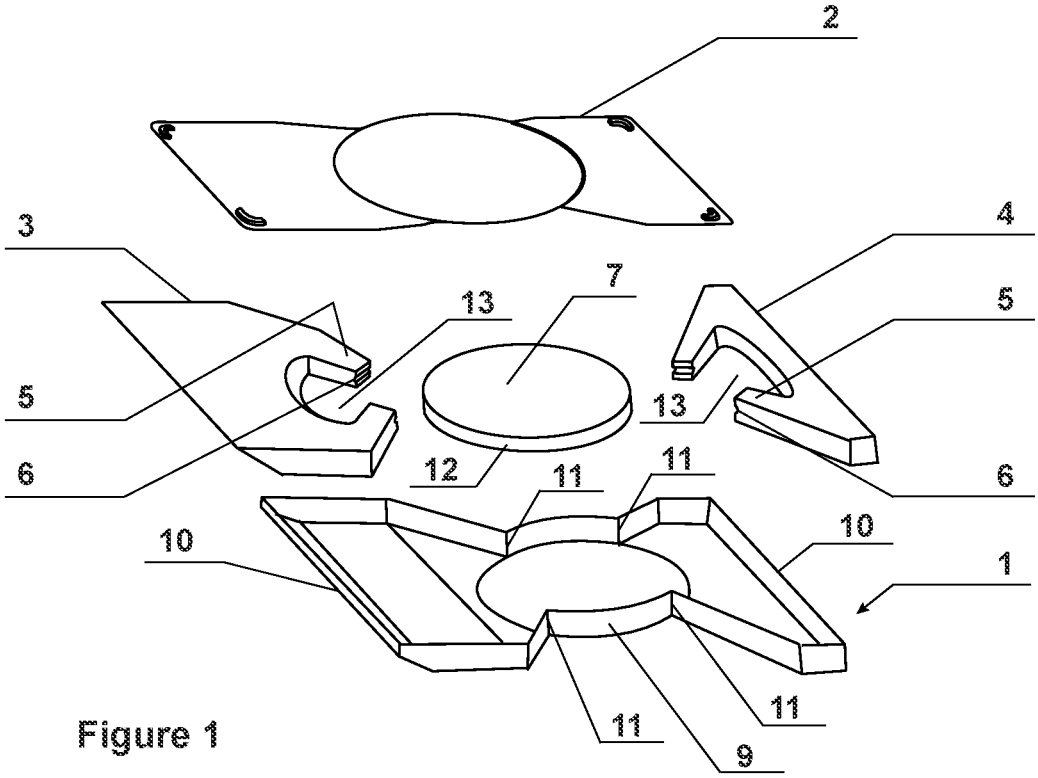
FIG. 1 is an exploded view of the proposed capsule, according to a preferred embodiment of the invention. For convenience of illustration, the capsule's parts are shown horizontally, though the capsule is usually positioned vertically.

While the invention may be susceptible to embodiment in different forms, there is shown in the drawings, and will be described in detail herein, a specific embodiment of the present invention, with the understanding that the present disclosure is to be considered an exemplification of the principles of the invention, and is not intended to limit the invention to that as illustrated and described herein.

As illustrated in FIG. 1, the inventive capsule is made of transparent materials, and comprises a body (1), an upper insert (3), a lower insert (4) and a cover (2), wherein the body (1) is joined with the cover (2).

As shown in FIG. 1, a coin (7), having a rim (12), is fixed in the body (1) by the upper insert (3) and the lower insert (4) each incorporating coin holders (5), whose shape is shown in FIG. 1 and described below. The upper insert (3), the lower insert (4), as well as the cover (2) are joined to the body (1) preferably by ultrasonic welding. The holders (5) are designed to allow fixing the coins of various sizes and shapes, including irregular shapes, inside the body (1).

The shape of the body (1) is preferably formed by a combination of two transparent cylinder segment surfaces (9) coupled with two open five-folded walls (i.e. having five facets) each forming a gap with two end ribs (11), wherein each such rib (11) adjoins the cylinder segment surfaces (9) from above and below respectively, wherein the two open five-folded walls are positioned opposite to each other (e.g. at the top and at the bottom of the body—see FIG. 2), and the two cylinder segment surfaces (9) are positioned opposite to each other (see FIG. 1).

Figure 2:
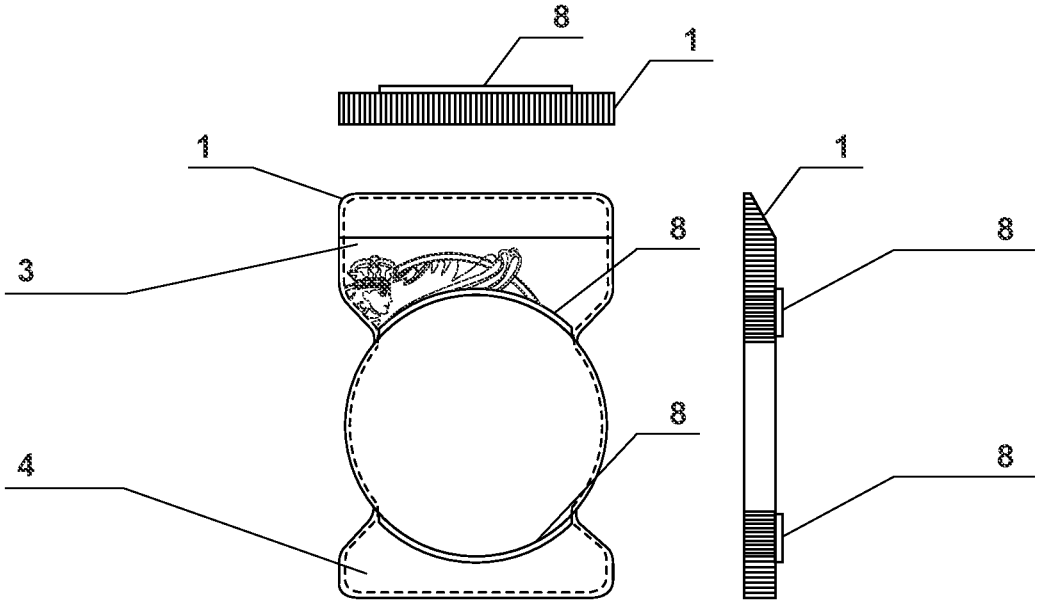
FIG. 2 is a view of three orthogonal projections of the body of the capsule, according to a preferred embodiment of the invention.

In the two-dimensional plane, it looks like two oppositely positioned circle arcs are coupled with two oppositely positioned open five-side planar figures (see FIG. 2). Each of the five-side planar figures is preferably composed of a rectangular part coupled with a curvilinear trapezoid figure, having a linear larger base adjoining the rectangular part, while two symmetrical converging sides and a concaved arc-shaped smaller base form an open gap of the curvilinear trapezoid figure. Thus, the cylinder segment surfaces, which are not covered (not hidden) by the two opposite open five-folded walls, provide overview of a flank of the coin (7) fixed therein. The coin's flank is known in the art as the 'rim'.

Figure 5:
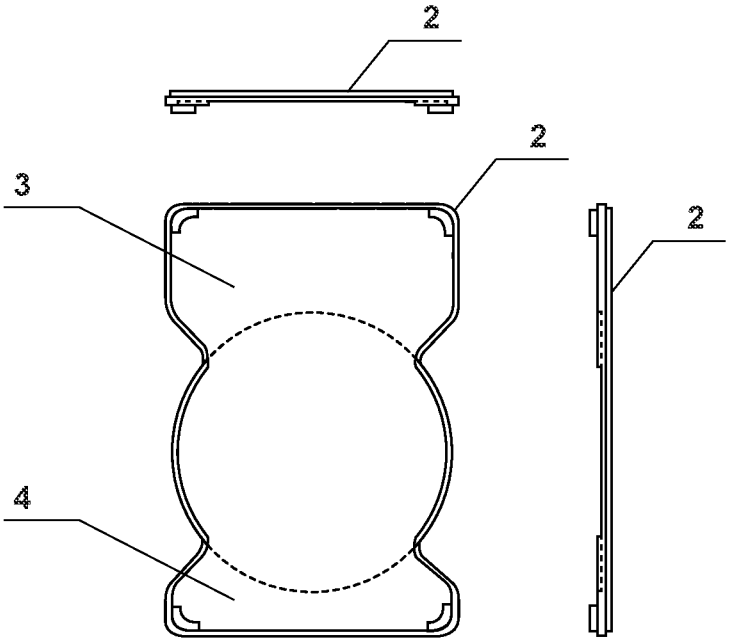
FIG. 5 is a view of three orthogonal projections of the capsule's cover, according to a preferred embodiment of the invention.

As shown in FIGS. 1 and 5, the cover (2) has a configuration similar to the above described combination of two-dimensional figures: two oppositely positioned circle arcs (being parts of one circle) are coupled with two oppositely positioned open five-side planar figures (see FIG. 5). The cover (2) closes the capsule from a lateral side opposite to the lateral side where the body (1) is located. As mentioned above, the body (1) is joined with the cover (2) preferably by ultrasonic welding.

In a preferred embodiment, the upper insert (3) and the lower insert (4) of the body (1) each has a shape of a prism having a trapezium-like cross-section with a small trapezium base (see FIG. 1). The upper insert (3) and the lower insert (4) of the body (1) each defines two protruding parts, herein called holders (5), and located at the open ends of the upper insert (3) and the lower insert (4). Each such prism includes a cavity (13) (preferably having a cross-section of C-shape) open in the location of the small trapezium base between the holders (5) of the corresponding prism (i.e. between the holders of the upper insert and between the holders of the lower insert). Such cavity (13) embraces at least a portion of the coin.

Each holder (5) has a slot (or slit) (6) formed at the end of the respective holder (5). The slot (6) serves for inserting and fixing the coin (7) in the capsule. The holder (5) should be made of a sufficiently elastic material, such that it should hold the coin (7) after it's inserted in the slot (6). The inserts (3) and (4) may also contain unique identification information about the coin, as well as its description and certification information.

Figure 3:
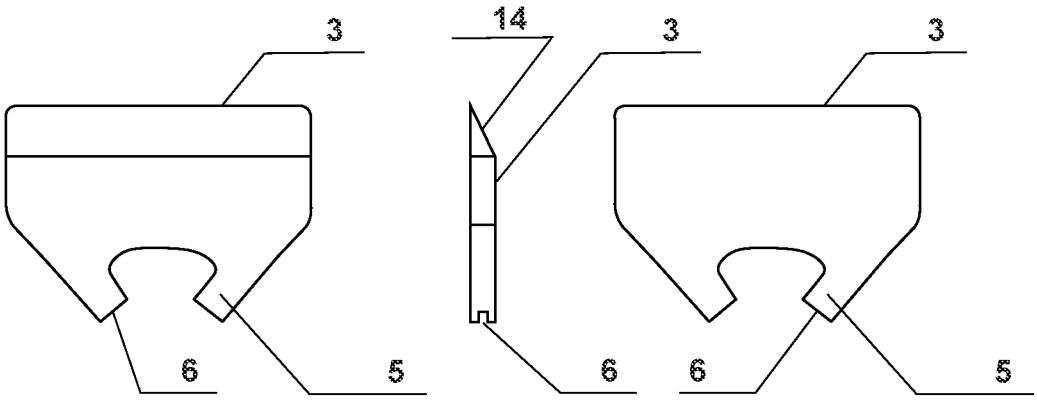
FIG. 3 is a view of three orthogonal projections of the upper insert of the capsule, according to a preferred embodiment of the invention.
Figure 4:
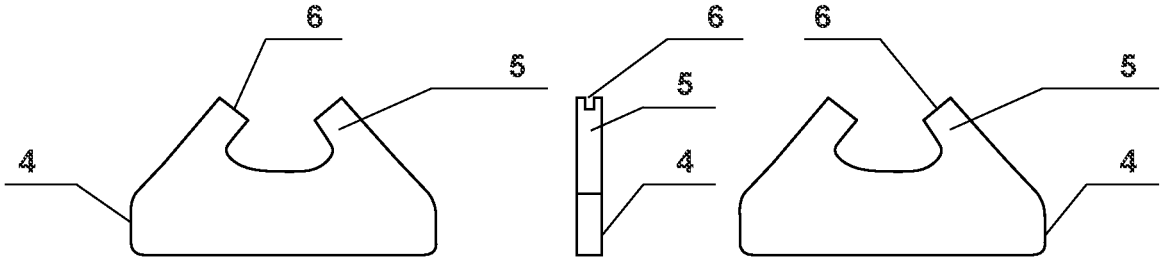
FIG. 4 is a view of three orthogonal projections of the lower insert of the capsule, according to a preferred embodiment of the invention.

In a preferred embodiment, the upper insert (3) and the lower insert (4) each has a shape of a prism having a trapezium-like cross-section; wherein, in a two-dimensional plane, the trapezium-like cross-section includes a linear larger base, two converging sides, and a concaved arc-shaped smaller base forming an open curvilinear gap between the holders (5) (see FIGS. 3-4).

As shown in FIG. 3 and FIG. 4, the upper insert (3) and lower insert (4) incorporate the holders (5) preferably having a 30 to 60 degree bevel (14) depending on the shape and size of the coin (7). The shape of the holder (5) corresponds to the shape of the body (1) at the point of contact of the holder (5) with the body (1).

The number of the holders (5) is not limited to and must be more than two (i.e. at least three) in total for all the holders. FIG. 3 and FIG. 4 depict two holders (5) of the upper insert (3) and two holders (5) of the lower insert (4), i.e. four holders (5) in total.

As mentioned above, fixing the coin in the inventive capsule envisages inserting the coin inside the slots (6). The inventive capsule preferably also includes a protective skirting (8) arranged along the peripheral surface thereof (as shown in FIG. 2).

The shape of the capsule allows a complete view of the encapsulated coin (7), including its rim (12). The technology contemplates inability to remove the coin after its encapsulation without damaging the capsule.

The preferable sizes of the body (1) are: length—85 mm, width—58 mm, thickness—9.85 mm (see FIG. 2).

The preferable sizes of the upper insert (3) are: length—46.9 mm, width—54.8 mm, thickness—5.3 mm (see FIG. 3).

The preferable sizes of the lower insert (4) are: length—33.8 mm, width—54.8 mm, thickness—5.3 mm (see FIG. 4).

The preferable sizes of the cover (2) are: length—85 mm, width—58 mm, thickness—2.6 mm (see FIG. 5).

When placing a coin into the capsule, the following actions must be performed:

- the coin must be fastened using holders of the upper insert and the lower insert, so its position is fixed in place inside the capsule, namely, the coin must be jammed between the holders fixed inside the body;
- after the coin is fixed, the body and the cover are joined preferably using ultrasonic welding.

INDUSTRIAL APPLICABILITY OF THE INVENTION

The use of the capsule for coin storage and examination will ensure preservation, convenient storage and identification of collector coins. At the same time, it will provide a possibility to use the capsule with coins of various shapes and sizes, including irregular shapes.

The invention claimed is:

1. A capsule for storage and examination of a coin (7); said coin (7) defines a coin shape including a rim (12); said capsule is made of transparent materials, and said capsule comprises:

a body (1), an upper insert (3), a lower insert (4), and a cover (2); wherein the upper insert (3), the lower insert (4), and the cover (2) are joined to the body (1); wherein: the body is formed by a combination of two cylinder segments (9) coupled with two open five-folded walls (10); each said five-folded wall (10) forms a gap with two end ribs (11); each said rib (11) is attached to the cylinder segments (9) respectively from above and below thereof; said two open five-folded walls (10) are positioned opposite to each other, and said two cylinder segments (9) are positioned opposite to each other; said two cylinder segments (9) provide for overview of the rim (12); the upper insert (3) and the lower insert (4) each has a shape of a prism; the upper insert (3) defines a number of upper coin holders (5) protruding therefrom, and the lower insert (4) defines a number of lower coin holders (5) protruding therefrom; wherein said upper insert (3) and said lower insert (4) each defines a cavity (13) created between the upper coin holders (5) and the lower coin holders (5) respectively, said cavity (13) each embraces a portion of the coin (7); and said upper coin holder (5) and said lower coin holder (5) each includes an end portion and a slot (6) formed in the end portion; and wherein each said slot (6) serves for inserting and fixing the coin (7) in said capsule.

2. The capsule according to claim 1, wherein said upper holders (5) and said lower holders (5) include a bevel (14) with an angle from 30 to 60 degrees; and said upper insert (5) and said lower insert (5) contain identification information about the coin (7), a description of the coin (7), and certification information of the coin (7).

3. The capsule according to claim 1, wherein; said body (1) has a length of 85 mm, a width of 58 mm, and a thickness of 9.85 mm; said upper insert (3) has a length of 46.9 mm, a width of 54.8 mm, and a thickness of 5.3 mm; said lower insert (4) has a length of 33.8 mm, a width of 54.8 mm, and a thickness of 5.3 mm; said cover (2) has a length of 85 mm, a width of 58 mm, and a thickness of 2.6 mm; and the upper insert (3), the lower insert (4), and the cover (2) are joined to the body (1) by ultrasonic welding.

4. A method of placing the coin (7) in the capsule, according to claim 1, said method comprising the steps of: fastening the coin (7) by inserting thereof into each said slot (6), so that a position of the coin (7) is fixed in place inside the capsule, while the coin (7) is jammed between the upper coin holders (5) and the lower coin holders (5); and joining the body (1) and the cover (2) using ultrasonic welding.

5. The capsule according to claim 1, wherein said capsule further comprises a protective skirting (8) arranged along a peripheral surface of said capsule.

* * * * *